US005584782A

United States Patent [19]

Szabo et al.

[11] Patent Number: 5,584,782

[45] Date of Patent: Dec. 17, 1996

[54] LOW IMPACT AEROBIC EXERCISE DEVICE

[75] Inventors: William J. Szabo, 10126 Langmuir Ave., Sunland, Calif. 91040; Adam A. Luedke, Bloomington, Minn.

[73] Assignee: William J. Szabo, Sunland, Calif.

[21] Appl. No.: 498,953

[22] Filed: Jul. 6, 1995

[51] Int. Cl.[6] ..... A63B 22/04

[52] U.S. Cl. ..... 482/52

[58] Field of Search ..... 482/52, 53, 908, 482/130, 123, 71, 57

[56] References Cited

U.S. PATENT DOCUMENTS

| | | | |
|---|---|---|---|
| 4,582,320 | 4/1986 | Shaw | 272/136 |
| 4,645,197 | 2/1987 | McFee | 272/65 |
| 5,016,869 | 5/1991 | Dick et al. | 272/70 |
| 5,072,932 | 12/1991 | Johnson | 272/116 |
| 5,178,599 | 1/1993 | Scott | 482/137 |
| 5,242,340 | 9/1993 | Jerome | 482/52 |
| 5,308,301 | 5/1994 | Chiarello | 482/53 |
| 5,338,277 | 8/1994 | Yang | 482/52 |
| 5,342,264 | 8/1994 | Gordon | 482/70 |
| 5,378,209 | 1/1995 | Kendrew | 482/52 |
| 5,407,407 | 4/1995 | Lin | 482/53 |
| 5,419,748 | 5/1995 | Snyderman et al. | 482/52 |
| 5,439,433 | 8/1995 | Lundin et al. | 482/52 |

FOREIGN PATENT DOCUMENTS

| | | |
|---|---|---|
| 2202135 | 7/1973 | Germany . |
| 2243794 | 3/1974 | Germany . |
| 1766432 | 10/1992 | U.S.S.R. . |

*Primary Examiner*—Stephen R. Crow
*Attorney, Agent, or Firm*—Sand & Sebolt

[57] ABSTRACT

A low-impact aerobic exercise device includes a base which supports a generally vertically extending frame member and an angularly extending brace member. Two spaced levers are pivotally mounted to the vertical frame member and have pedals mounted on their outer ends for independent reciprocal pivotal movement when used as a stair-stepping type of exercise device. Two resilient elastomeric members are adjustably attached between the brace member and the two levers to provide vertical downward resistance when the user pivotally oscillates the levers in an up-and-down motion. A handle is attached to the vertical member for grasping by the user. An insert can be removably mounted between the lever pedals to provide a single continuous platform joining the two levers, enabling the lever to be used as a rebounding type of exercise device. The frame member is pivotally attached to the vertical frame member, enabling the device to be moved to a compact collapsed position for storage.

22 Claims, 5 Drawing Sheets

LOW IMPACT AEROBIC EXERCISE DEVICE

BACKGROUND OF THE INVENTION

1. Technical Field

The invention relates to an exercise device. More particularly, the invention relates to a low impact aerobic exercise device which is capable of producing a rebounding motion similar to that of a pogo stick as well as simulating stair climbing to provide cardiovascular benefits to the user with minimum impact on the user's joints.

2. Background Information

In recent years, there has been a proliferation of different types of exercise devices on the market. These exercise devices range from stair climbers, to tread mills, to cross-country ski machines. Many of these devices are driven by motors and require hydraulic and pneumatic cylinders as their means of resistance, or require the user to supply an equal but opposite force to get the device back to it's starting position. One such device which uses a fluid activated shock absorber is shown in prior art U.S. Pat. No. 5,178,599. These types of devices are highly sophisticated, require regular maintenance and may be difficult for the consumer to assemble at home.

Other prior art exercise devices use various mechanical components such as gears, belts, pulleys, and the like for operating the device. U.S. Pat. No. 5,242,340 shows one such device which uses a pulley mechanism to provide resistance. These mechanical components can break and may be difficult to fix or maintain. Another drawback to such existing exercise devices are that they are often big, bulky, heavy and expensive to manufacture and ship.

Another type of aerobic exercise device uses a resiliently mounted platform which moves up and down under the weight of a user with the resulting reciprocating motion converted by various means to kinetic energy which lifts the user back to the starting position. By bending the knees with proper timing the user creates an oscillating rhythmic motion which provides an aerobic cardiovascular workout.

These oscillating type devices are often driven by motors and contain many mechanical parts and fluid activated components. The devices in U.S. Pat. No. 4,645,197 and U.S. Pat. No. 5,419,748 show such oscillating devices which use a hydraulic cylinder as the resistance element. U.S. Pat. No. 5,242,340 shows a similar type of device which employs a chain driven sprocket and a friction drum.

Although these prior art devices were presumably adequate for the purposes for which they were intended, the present invention improves upon some of the drawbacks of these devices. Some of the drawbacks in these prior devices are that they may require so little effort to operate, they do not provide a sufficient workout. Also the frequency of the oscillations changes depending upon the weight of the user and is not adjustable, therefore a different range of motion is produced for users of different sizes. Furthermore certain of these prior art devices are often bulky and heavy, and occupy a large amount of space even when not in use.

Thus, the need exists for a oscillating type of low impact aerobic exercise device which has a very simple means of resistance, which has few easily accessible mechanical parts, which is lightweight, which is collapsible for compact storage and shipment, which is adjustable for users of different weights, which is inexpensive to manufacture and ship, yet is versatile in that it is capable of supplying the user with a plurality of aerobic exercises, which provides for a maximum cardiovascular workout and provides muscle toning and firming for the upper as well as the lower body.

SUMMARY OF THE INVENTION

Objectives of the present invention include providing an exercise device which provides a cardiovascular workout, tones and firms both the upper and lower body, and produces little if any impact on the user's joints.

Another objective of the present invention is to provide such a device which has a pair of independently pivotally connected levers with pedals or footplates mounted on their outer ends, which can be connected together by a readily attached inset to provide simple oscillating motion simultaneous to both levers and footplates, yet can be removed to provide independent movement to each of the pedals whereby the device can be used as a stair stepper type of equipment.

A still further objective of the present invention is to provide such an exercise device which uses simple resilient members or bands which provide a vertical downward resistance on the levers when depressed by a user standing thereon.

Another objective of the present invention is to provide such a device in which the resilient members are easily adjustable to provide equal resistance and thus an equal workout, to users of different weights, and to provide various levels of exertion to the user.

Still another objective of the present invention is to provide such a device which is readily collapsible whereby the device can be stored in a small area when not in use.

A further objective of the present invention is to provide such a device which is constructed of a light weight tubing, which is relatively inexpensive to manufacture and ship, yet which provides a safe and steady device.

These objectives and advantages are obtained by the exercise device of the present invention the general nature of which may be stated as including a base; an upright support extending from the base; handle means attached to the upright support for grasping by a user of said device; a pair of spaced apart levers, each having first and second ends, said first ends being pivotally attached to the upright support; a pair of resilient members extending between and connected to the upright support and each of the levers to provide downward vertical resistance on the levers when a user presses down on the levers; and adjustment means formed on the levers for adjusting the location on the connection of the resilient member to the lever to adjust the vertical resistance provided by the resilient members.

BRIEF DESCRIPTION OF THE DRAWINGS

Preferred embodiments of the invention, illustrative of the best modes in which applicants have contemplated applying the principles, are set forth in the following description and are shown in the drawings and are particularly and distinctly pointed out and set forth in the appended claims.

Similar numbers refer to similar parts throughout the drawings.

DESCRIPTION OF THE PREFERRED EMBODIMENTS

Figure 1:
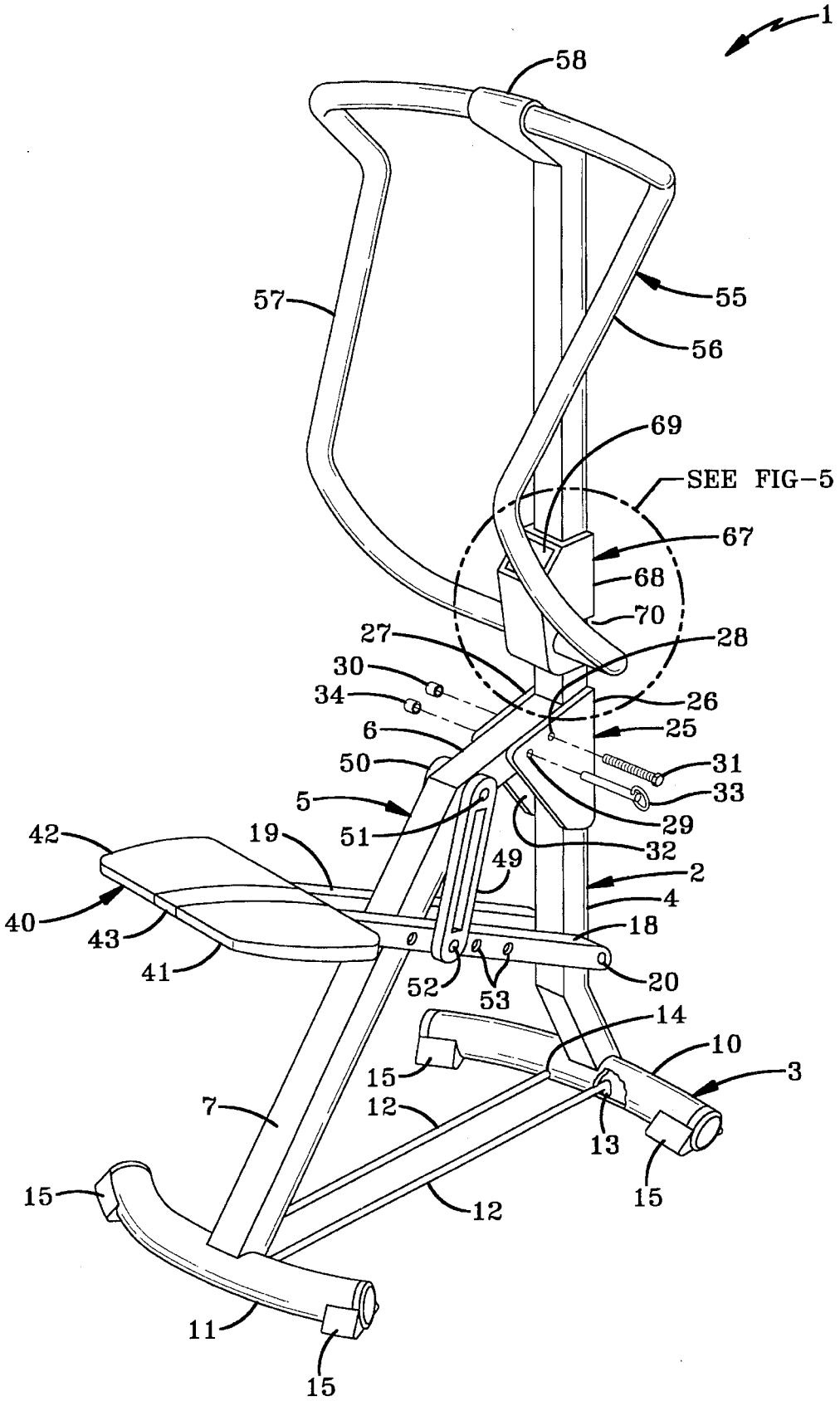
FIG. 1 is a perspective view showing a first embodiment of the exercise device of the present invention.

Referring to FIG. 1 of the drawings, there is shown therein a first embodiment of the exercise device of the present invention indicated generally as 1. Device 1 includes a base indicated generally at 3 and an upright support indicated generally at 2. Upright support 2 extends upwardly from base 3 and is preferably constructed of a square cross-sectioned shaped lightweight tubing. Upright support 2 includes a generally vertical extending member 4 and a brace member 5 extending between vertical member 4 and base 3. Brace member 5 includes a first section 6 extending orthogonally outward from vertical member 4 and a second section 7 extending angularly between brace section 6 and base 3.

Figure 2:
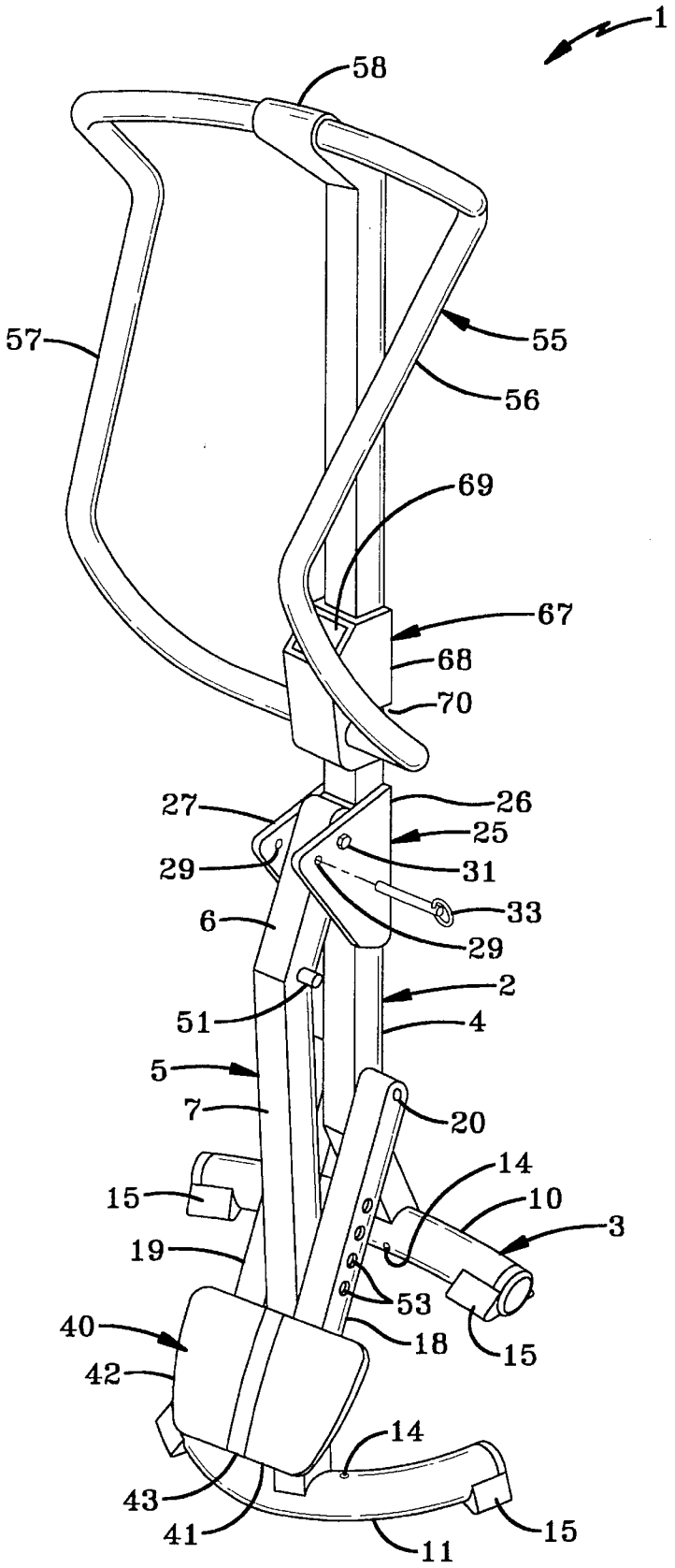
FIG. 2 is a perspective view showing the exercise device of FIG. 1 in a collapsed position.

Base 3 includes a pair of curvedly shaped spaced legs 10 and 11, preferably constructed of a cylindrical shaped lightweight tubing. An anti-skid pad 15 preferably is mounted on the outer ends of legs 10 and 11 to provide increased stability to device 1. A pair of removable stabilizing rods 12 extend between legs 10 and 11, whereby base 3 stabilizes upright support 2 on a horizontal surface. Rods 12 have two hooked ends 13 which are removably inserted into a pair of holes 14 formed in legs 10 and 11 to enable device 1 to be collapsed for storage as shown in FIG. 2.

Vertical member 4 extends generally upwardly and vertically from leg 10 and brace member 5 extends angularly between vertical member 4 and leg 11. Vertical member 4 and brace section 6 of brace member 5 are pivotally connected by a pivot mechanism, indicated generally at 25. Pivot mechanism 25 includes a pair of triangularly shaped brackets 26 and 27, formed with aligned holes 28 and 29 for receiving a pivot bolt 31 and nut 30, and a locking pin 33 and associated fastener 34. Brackets 26 and 27 are attached to each side of vertical member 4 such as by welding, and form an intervening recess 32. Pivot bolt 31 extends between brackets 26 and 27 and brace member 5, whereby a first end of brace section 6 is inserted into recess 32 and bolt 31 is inserted into holes 28 and through a set of holes (not shown) in brace member 5, pivotally securing brace member 5 to vertical member 4. Locking pin 33 is removably inserted into holes 29 and extends between brackets 26 and 27 and through a second set of holes (not shown) in brace member 5.

A pair of spaced apart levers 18 and 19 are pivotally attached at first or inner ends to opposite sides of vertical member 4 by fasteners 20. Second or outer ends of levers 18 and 19 extend adjacent to and beyond brace section 7 of brace member 5, and have a platform indicated generally at 40, attached to and extending between the outer ends of levers 18 and 19 for joining levers 18 and 19 and providing a support to be stood upon by a user of exercise device 1.

Figure 4:
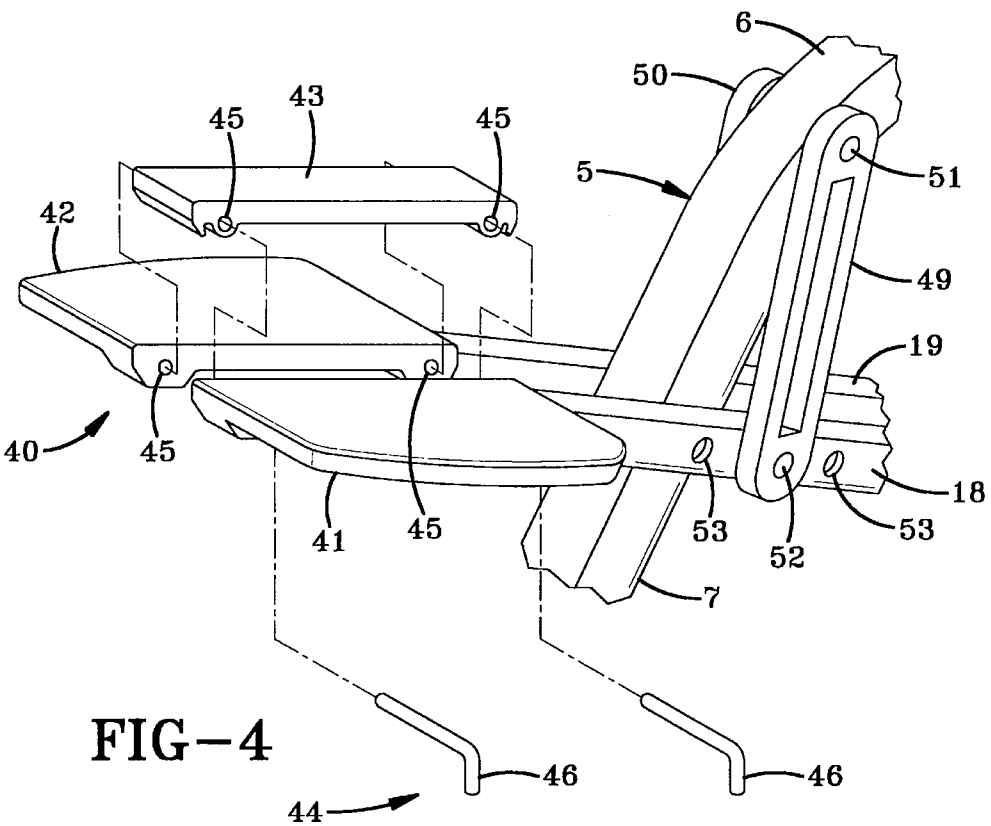
FIG. 4 is a fragmentary exploded perspective view showing an insert which connects the two independently movable pedals of the first and second embodiments.

Platform 40 includes separate pedals 41 and 42 mounted on the outer ends of levers 18 and 19 respectively, and an insert plate 43 removably secured between the levers by fasteners 44 (FIG. 4) to provide platform 40 with a substantially smooth continuous top surface. Fasteners 44 include a plurality of aligned holes 45 formed in pedals 41 and 42 and in plate 43, and a plurality of L-shaped pins 46 extending through holes 45 and between pedals 41 and 42 and plate 43.

A pair of resilient members 49 and 50, such as elastomeric bands, extend between brace section 6 and levers 18 and 19 respectively, and provide vertical downward resistance on levers 18 and 19. Fasteners 51 removably attach a first end of resilient members 49 and 50 to opposite sides of brace section 6. In accordance with one of the features of the invention, a plurality of holes 53 are formed in the sides of levers 18 and 19 to removably attach a second end of resilient members 49 and 50 thereto by fasteners 52. Holes 53 and fasteners 52 provide for easily adjusting the attachment position of resilient members 49 and 50 to levers 18 and 19, whereby adjusting the attachment position changes the amount of downward vertical resistance applied on the levers by the resilient members.

Figure 5:
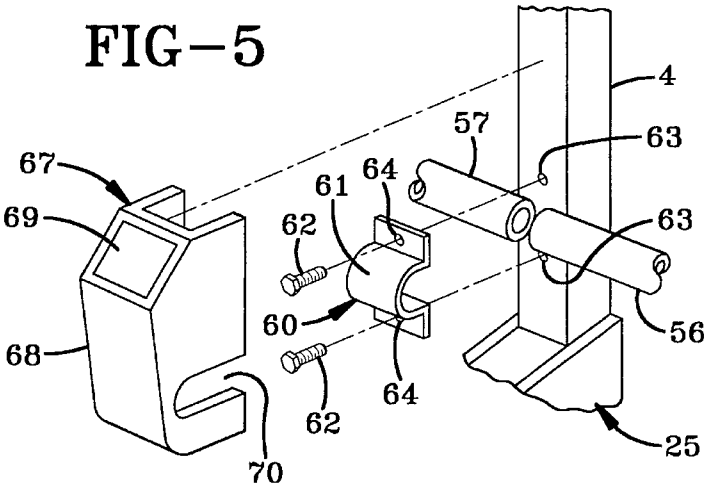
FIG. 5 is a fragmentary exploded perspective view showing the attachment of the handle to the upright support of the exercise device of FIG. 1 and an electronic device attached thereto.

A handle indicated generally at 55, is attached to upright support 2 for grasping by a user when using exercise device 1. Handle 55 includes a pair of contoured tubular members 56 and 57 mounted on and extending outwardly from vertical member 4. Tubular members 56 and 57 extend in a generally vertical and upward direction and are supported by a clamp 58 located at an upper end of vertical member 4 (FIG. 1). Tubular members 56 and 57 each includes a lever end which is attached by an attachment assembly 60 (FIG. 5) to an intermediate position of vertical member 4 adjacent to pivot mechanism 25.

Attachment assembly 60 (FIG. 5) includes a U-shaped clamp 61 and a pair bolts 62 which are inserted through a pair of holes 64 formed in clamp 61, and are received by a pair of internally threaded holes 63 formed in vertical member 4. An electronic device 67 which includes a plastic housing 68, a LED display window 69, and two U-shaped recesses 70 is fastened to vertical member 4 whereby housing 68 covers attachment assembly 60 to provide an attractive appearance to device 1. U-shaped recesses 70 are located on opposite sides of electronic device 67 and receive tubular members 56 and 57 therein, whereby each side of electronic device 67 extends adjacently to each side of vertical member 4.

In accordance with another of the many features of the exercise device of the present invention and as shown in FIG. 2, the device may be collapsed when not in use for ease of storage and handling. Cross members 12 are unhooked and removed from holes 14 of at least one of the base legs. Resilient members 49 and 50 are removed from levers 18 and 19 respectively, or from first section 6 of brace member 5, and locking pin 33 is removed from hole 29. When in this configuration, brace member 5 is pivoted downwardly around pivot bolt 31 and levers 18 and 19 may be pivoted around fasteners 20, whereby platform 40 rests against collapsed section 7 of brace member 4, and the device may be stored without occupying a large amount of space when not in use. Locking pin 33 can be reinserted through holes 29 (FIG. 2) to lock the device in the collapsed position.

Figure 3:
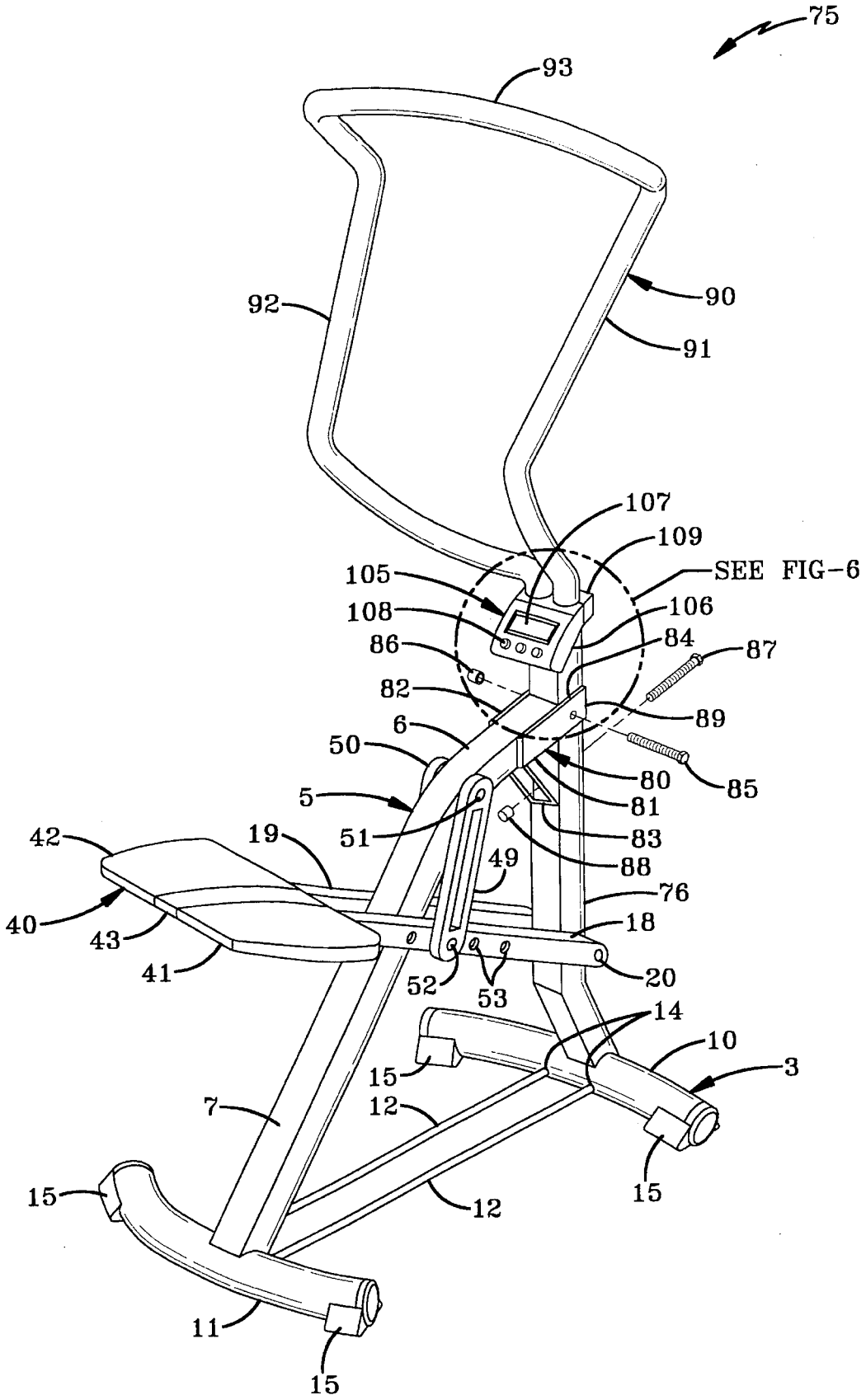
FIG. 3 is a perspective view showing a second embodiment of the exercise device of the present invention.

A second embodiment of the exercise device of the present invention is shown in FIG. 3 and is indicated generally at 75. Device 75 is substantially similar to device 1 in that it includes a base 3, a brace member 5, levers 18 and 19, a platform 40, and resilient members 49 and 50. Device 75 further includes a vertical member 76 which is generally similar to vertical member 4 of device 1, except that vertical member 76 is shorter in length than vertical member 4 and does not support a handle at its upper end.

Device 75 includes a pivot mechanism indicated generally at 80, which includes two flanges 81 and 82 (FIG. 3) and a triangularly shaped bracket 83. Flanges 81 and 82 are aligned with and protrude from each side of brace section 6 of brace member 5 forming a recess 84 therebetween, which receives vertical member 76. Bracket 83 is fastened to the bottom of brace section 6 adjacent member 76 by welding or other attachment means. Locking pin 33 can be reinserted through holes 29 (FIG. 2) to lock the device in the collapsed position. A bolt 85 extends through holes 89 formed in flanges 81 and 82 and an aligned hole formed in vertical member 76 and is secured with a nut 86. A second bolt 87 extends through a hole formed in the back and front sides of vertical member 76, through bracket 83 and is secured with a nut 88. Bolts 85 and 87 removably attach brace member 5 to vertical member 76, and when removed allows device 75 to be collapsed for storage in a manner generally similar to that shown in FIG. 2 for device 1.

Figure 6:
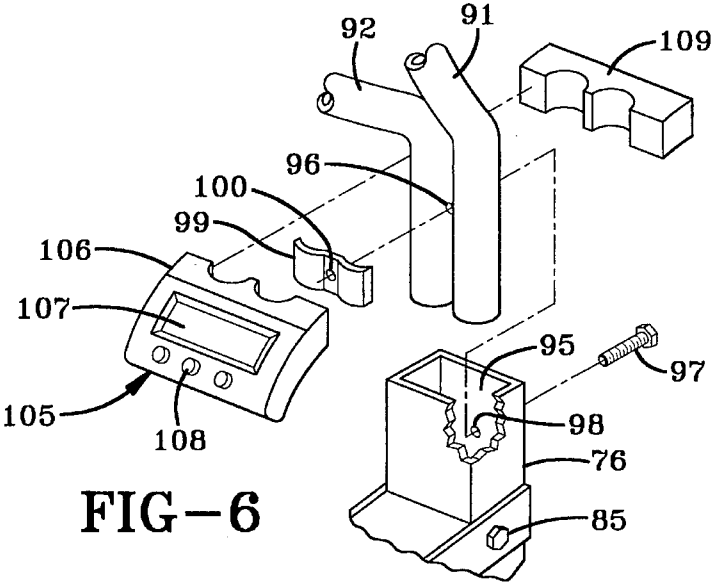
FIG. 6 is a fragmentary exploded perspective view showing the attachment of the handle to the upright support of the exercise device of FIG. 2 and an electronic device attached thereto.

A handle 90 includes two contoured tubular members 91 and 92, the ends of which are attached to and extend upwardly from an upper end of vertical member 76 (FIGS. 3 and 6) and a generally horizontal tubular arced member 93 which extends between tubular members 91 and 92 to form a loop configuration. A hollow interior 95 (FIG. 6) of vertical member 76 receives the ends of tubular members 91 and 92. A hole 96 is formed between and through tubular members 91 and 92 and a bolt 97 is inserted through a hole 98 formed in the back side of vertical member 76, through hole 96 and is secured within a hole 100 of a double U-shaped clamp 99 to mount handle 90 on member 76.

An electronic device 105 is mounted on vertical member 76 and includes a housing 106, an LED display 107, a plurality of buttons 108 and a back fastening member 109. Housing 106 covers the front of the insertion point of tubular member 91 and 92 into vertical member 76, and back fastening member 109 covers the back of the insertion point of tubular member 91 and 92 into vertical member 76 whereby housing 106 is attached to back fastening member 109 securing electronic device 105 to vertical member 76 (FIG. 3) in an attractive manner.

Figure 7:
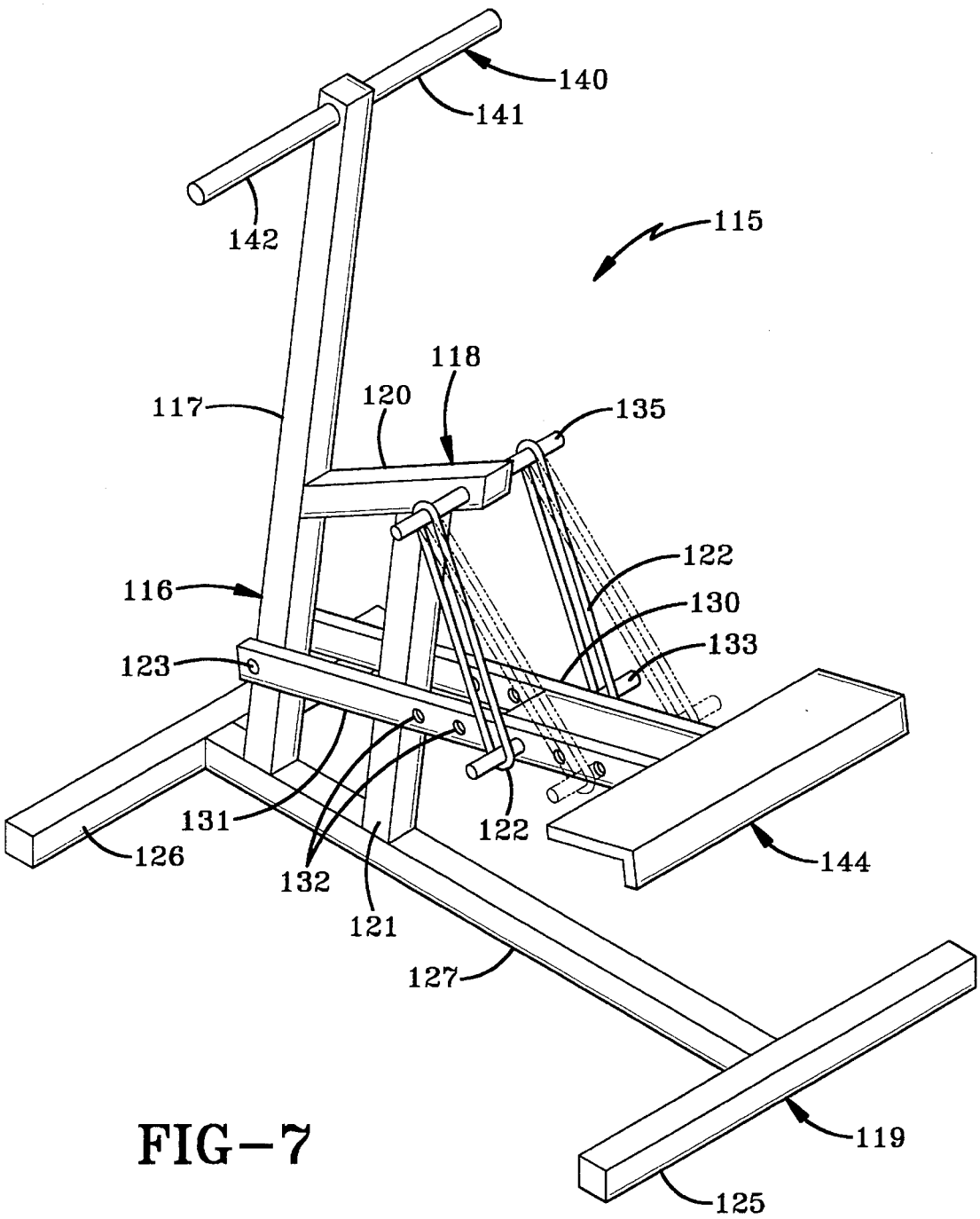
FIG. 7 is a perspective view showing a third embodiment of the exercise device of the present invention.

FIG. 7 shows a third embodiment of the exercise device of the present invention, and is indicated generally at 115. Device 115 is similar in many respects to devices 1 and 75 and includes a platform 144 and a pair of resilient members 122. Device 115 includes an upright support indicated generally at 116, which is similar to support 2 of device 1, in that upright support 116 includes a vertical member 117 and a brace member 118 which extends outwardly from and is connected between support 116 and a base 119.

Base 119 is generally similar to base 3 of device 1 in that base 119 includes two spaced legs 125 and 126 and a fixed cross member 127. Base 119 is preferably constructed of a square cross-sectioned shaped lightweight tubing. Brace member 118 of includes a first section 120 and a second section 121, but unlike brace member 5 of device 1, first section 120 extends at an upward outward angle from vertical member 117 and second section 121 extends vertically between first section 120 and cross member 127.

Two spaced apart levers 130 and 131 are pivotally attached to vertical member 117 by fasteners 123 in a manner similar to levers 18 and 19 of devices 1 and 75. Levers 130 and 131 are formed with a plurality of attachment holes 132 for receiving a bar 133. Bar 133 extends between selected aligned holes 132 for easily and removably attaching the ends of resilient members 122 thereon, whereby moving bar 133 to different attachment positions varies the vertical resistance of levers 130 and 131 and progressively challenges the user's muscles to thereby strengthen and tone the desired muscles specific to the exercise. The other ends of resilient members 122 are removably attached to a bar 135 which extends through a pair of aligned holes formed in an outer end of first section 120.

A handle 140 extends through a hole formed in the upper end of vertical member 117 and includes two tubular end members 141 and 142 which extend orthogonally from each side of vertical member 117.

A single platform member 144 is mounted on and extends across the outer ends of levers 130 and 131 to provide for the simultaneous movement of the levers when in use.

In operation of devices 1, 75 and 115, the user stands on platform 40 or 144 while grasping handles 55 or 140 with both hands. The user pushes his body weight downward while simultaneously straightening his legs, forcing the platform in a vertically downward direction. Resilient members 49, 50 and 122 provide vertical downward resistance on the platform. When the users legs are extended and the platform has reached its downward limit, the user pulls his body weight up using the handle while simultaneously bending his knees and allowing the platform to be pulled up by the resilient members. When the platform is returned to its original up position the user again pushes his body weight down using the handles while simultaneously straightening his legs again forcing the platform downwardly. This motion is repeated creating an oscillating motion of the platform and providing the user with a maximum cardiovascular workout and muscle toning and firming for the upper as well as the lower body.

In accordance with one of the many features of the exercise device of the present invention, insert 43 is removable in embodiments 1 and 75 allowing independent movement of levers 18 and 19, allowing the exercise device to be used as a stair stepper in contrast to the oscillating rebounding action that is achieved when the pedals are connected together or formed as a single member as in embodiment 115. In the stair stepper configuration, the user places one foot on each of pedals 41 and 42 while grasping handle 55 with both hands. The user begins to push either one of the pedals 41 and 42 downwardly. The user coordinates the downward movement of foot pedals 41 and 42 so that when one of the foot pedals is moved downwardly, the other foot pedal moves upwardly. This independent up-and-down movement causes the resilient members 49 and 50 to move relative to each other providing vertical downward resistance upon levers 18 and 19, and thus upon foot pedals 41 and 42 respectively. This motion is repeated as if the user were climbing up a continuous flight of stairs.

Accordingly, the low impact aerobic exercise device of the present invention includes simple and easily adjustable elastomeric resistance members which allow for variable vertical resistance thereby progressively challenging the user's muscles to strengthen and tone the desired muscles specific to the exercise. Furthermore, embodiments 1 and 75 can be collapsed when not in use providing for easy storage without occupying a large amount of space. Likewise, embodiments 1 and 75 have two independently operable levers which can be combined together requiring simultaneous movement or kept separate allowing for independent and alternating movement of the levers.

Accordingly, the exercise device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved low impact aerobic exercise device is constructed and used, the characteristics of the construction, and the advantageous, new and useful results obtained; the new and useful structures, devices, elements, arrangements, parts and combinations, are set forth in the appended claims.

We claim:

1. An exercise device, including:

a base;

an upright support extending from the base;

handle means attached to the upright support for grasping by a user of said device;

a pair of spaced apart levers, each having first and second ends, said first ends being pivotally attached to the upright support;

platform means attached to and extending between the second ends of the levers for securing said second ends together for simultaneous pivotal movement of the levers;

a pair of elastomeric members extending between and connected to the upright support and the levers to provide a downward vertical resistance on the levers when a user presses down on the levers and to provide a subsequent upward return force on the levers, said elastomeric members providing the only downward resistance and upward return force on the levers; and adjustment means formed on the levers for adjusting the location of the connection of the elastomeric members to the levers to adjust the vertical resistance and the upward return force provided by the elastomeric members.

2. The exercise device defined in claim 1 in which the upright support includes a generally vertically extending member and a brace member extending between said vertical member and the base.

3. The exercise device defined in claim 2 in which the elastomeric members extend between the brace member of the upright support and the levers.

4. The exercise device defined in claim 1 in which the adjustment means includes a plurality of attachments spaced along each of the levers and a fastener for selectively attaching a first end of each of the elastomeric members to said attachments.

5. The exercise device defined in claim 4 in which the attachments include a plurality of spaced holes formed in the levers; and in which the fastener is a bar which extends through said holes.

6. The exercise device defined in claim 2 including pivot means for pivotally connecting the brace member to the vertical member to enable the device to be pivoted to a collapsed position for storage.

7. The exercise device defined in claim 6 in which the pivot means includes a bracket attached to the vertical member and a pivot pin extending between said bracket and the brace member.

8. The exercise device defined in claim 2 in which the base includes a pair of spaced legs and a cross member extending between said legs; and means for removably attaching the cross member to at least one of the spaced legs.

9. The exercise device defined in claim 2 including attachment means for removably attaching an end of the brace member to the vertical member to permit said device to be collapsed for storage.

10. An exercise device, including:

a base having a pair of spaced-apart legs and a cross member extending between said legs, said cross member being removably attached to one of the legs enabling the device to be moved to a collapsed position for storage;

an upright support extending from the base, including a generally vertically extending upright member and a brace member extending between said vertical member and the base;

a handle means attached to the upright support for grasping by a user of said device;

a pair of spaced apart levers, each having first and second ends, said first ends being pivotally attached to the upright support;

resistance means extending between and connected to the upright support and the levers for providing downward vertical resistance on the levers when a user presses down on the platform means; and attachment means for movably attaching the brace member to the vertical member, enabling the brace member to be moved to a position closely adjacent said vertical member for storage.

11. The exercise device defined in claim 10 in which the attachment means includes a bracket attached to the upright member, a pivot member pivotally connecting the brace member to the bracket, and a removable locking member for selectively securing the device in collapsible and operative positions.

12. The exercise device defined in claim 11 in which the bracket includes spaced-apart bracket members; and in which an end of the brace member is pivotally mounted between said bracket members.

13. The exercise device defined in claim 10 in which a pedal is mounted on an end of each of the levers; and in which an insert plate is removably attached to and between the pedals to form a platform having a substantially continuous top surface, and fastening means for removably attaching the insert plate to and between the pedals.

14. The exercise device defined in claim 10 including adjustment means formed on the levers for adjusting the location of the connection of the resistance means to the lever to adjust the vertical resistance provided by the resistance means.

15. The exercise device defined in claim 10 in which the handle means includes a pair of contoured tubular members mounted on and extending outwardly from the upright support, and attachment means for attaching the tubular members to the upright support.

16. The exercise device defined in claim 15 in which the tubular members are attached to and extend between an upper end of the upright support and an intermediate position of said support.

17. An exercise device, including:

a base including a pair of spaced legs and a cross member extending between said legs, and means for removably attaching the cross member to at least one of the spaced legs;

an upright support extending from the base, said support including a generally vertically extending member and a brace member extending between said vertical member and the base;

handle means attached to the upright support for grasping by a user of said device;

a pair of spaced apart levers, each having first and second ends, said first ends being pivotally attached to the upright support;

a pair of resilient members extending between and connected to the upright support and each of the levers to provide downward vertical resistance on the levers when a user presses down on the levers; and adjustment means formed on the levers for adjusting the location on the connection of the resilient members to the levers to adjust the vertical resistance provided by the resilient members.

18. An exercise device, including:

a base;

an upright support extending from the base, said support including a generally vertically extending member and a brace member extending between said vertical member and the base;

attachment means for removably attaching an end of the brace member to the vertically extending member to permit said device to be collapsed for storage;

handle means attached to the upright support for grasping by a user of said device;

a pair of spaced apart levers, each having first and second ends, said first ends being pivotally attached to the upright support;

a pair of resilient members extending between and connected to the upright support and each of the levers to provide downward vertical resistance on the levers when a user presses down on the levers; and adjustment means formed on the levers for adjusting the location on the connection of the resilient members to the levers to adjust the vertical resistance provided by the resilient members.

19. An exercise device, including:

a base;

an upright support extending from the base;

handle means attached to the upright support for grasping by a user of said device;

a pair of spaced apart levers, each having first and second ends, said first ends being pivotally attached to the upright support;

a pedal mounted on an end of each of the levers;

an insert plate removably attached to and extending between the pedals to form a platform having a substantially continuous top surface;

fastening means for removably attaching the insert plate to and between the pedals, said fastening means including a plurality of holes formed in the pedals and insert plate, and a plurality of fasteners extending through said holes and between the pedals and insert plate;

a pair of resilient members extending between and connected to the upright support and each of the levers to provide downward vertical resistance on the levers when a user presses down on the levers; and adjustment means formed on the levers for adjusting the location on the connection of the resilient members to the levers to adjust the vertical resistance provided by the resilient members.

20. An exercise device, including:

a base;

an upright support extending from the base, said support having a generally vertically extending member and a brace member extending between said vertical member and the base; said base having a pair of spaced legs and a cross member extending between said legs, and means for removably attaching the cross member to at least one of the spaced legs;

handle means attached to the upright support for grasping by a user of said device;

a pair of spaced apart levers, each having first and second ends, said first ends being pivotally attached to the upright support;

a pair of elastomeric members extending between and connected to the upright support and the levers to provide a downward vertical resistance on the levers when a user presses down on the levers and to provide a subsequent upward return force on the levers, said elastomeric members providing the only downward resistance and upward return force on the levers; and adjustment means formed on the levers for adjusting the location of the connection of the elastomeric members to the levers to adjust the vertical resistance and the upward return force provided by the elastomeric members.

21. An exercise device, including:

a base;

an upright supporting extending from the base, said support having a generally vertically extending member and a brace member extending between said vertical member and the base;

handle means attached to the upright support for grasping by a user of said device;

a pair of spaced apart levers, each having first and second ends, said first ends being pivotally attached to the upright support;

a pair of elastomeric members extending between and connected to the upright support and the levers to provide a downward vertical resistance on the levers when a user presses down on the levers and to provide a subsequent upward return force on the levers, said elastomeric members providing the only downward resistance and upward return force on the levers;

adjustment means formed on the levers for adjusting the location of the connection of the elastomeric members to the levers to adjust the vertical resistance and the upward return force provided by the elastomeric members; and attachment means for removably attaching an end of the brace member to the vertically extending member to permit said device to be collapsed for storage.

22. An exercise device, including:

a base;

an upright support extending from the base;

handle means attached to the upright support for grasping by a user of said device;

a pair of spaced apart levers, each having first and second ends, said first ends being pivotally attached to the upright support;

a pedal mounted on an end of each of the levers;

an insert plate removably attached to and extending between the pedals to form a platform having a substantially continuous top surface, and fastening means for removably attaching the insert plate to and between the pedals, said fastening means including a plurality of holes formed in the pedals and insert plate, and a plurality of fasteners extending through said holes and between the pedals and insert plate;

a pair of elastomeric members extending between and connected to the upright support and the levers to provide a downward vertical resistance on the levers when a user presses down on the levers and to provide a subsequent upward return force on the levers, said elastomeric members providing the only downward resistance and upward return force on the levers; and adjustment means formed on the levers for adjusting the location of the connection of the elastomeric members to the levers to adjust the vertical resistance and the upward return force provided by the elastomeric members.

* * * * *